US010517786B1

(12) United States Patent
Lue

(10) Patent No.: US 10,517,786 B1
(45) Date of Patent: Dec. 31, 2019

(54) DENTAL CHAIR ARMREST

(71) Applicant: David Lue, Miami, FL (US)

(72) Inventor: David Lue, Miami, FL (US)

( * ) Notice: Subject to any disclaimer, the term of this patent is extended or adjusted under 35 U.S.C. 154(b) by 0 days.

(21) Appl. No.: 16/513,822

(22) Filed: Jul. 17, 2019

(51) Int. Cl.
*A61G 13/10* (2006.01)
*A61G 13/12* (2006.01)
*A61G 15/12* (2006.01)
*A47C 7/54* (2006.01)

(52) U.S. Cl.
CPC ..... *A61G 15/12* (2013.01); *A47C 7/541* (2018.08); *A47C 7/546* (2013.01); *A61G 2203/70* (2013.01)

(58) Field of Classification Search
CPC .... A47C 7/54; A47C 7/62; A47C 1/03; A61G 5/125; F16M 2200/065
See application file for complete search history.

(56) References Cited

U.S. PATENT DOCUMENTS 2,614,471 A * 10/1952 Markowitz ..... G03B 15/041 396/422
3,124,328 A * 3/1964 Kortsch ..... A47C 1/03 248/118
3,436,046 A * 4/1969 Valeska ..... A61G 15/14 248/284.1
4,140,296 A * 2/1979 Guzman Guillen ..... A47B 23/007 248/286.1
4,458,870 A * 7/1984 Duncan ..... A47C 7/70 248/279.1
5,281,001 A * 1/1994 Bergsten ..... A47B 21/0371 248/118
5,369,805 A * 12/1994 Bergsten ..... A47B 21/0371 297/411.23
5,405,109 A * 4/1995 Nordnes ..... A47B 21/0371 248/118.3
5,462,338 A * 10/1995 Baumann ..... A47C 1/03 297/383
5,597,207 A * 1/1997 Bergsten ..... A47B 21/0371 297/411.23
5,851,054 A * 12/1998 Bergsten ..... A47B 21/0371 297/411.35
5,884,974 A * 3/1999 Bergsten ..... A47B 21/0371 297/411.35
6,022,079 A * 2/2000 Bergsten ..... A47B 21/0371 297/411.35
6,050,533 A * 4/2000 Cruz ..... E04G 3/18 248/208

(Continued)

*Primary Examiner* — Shin H Kim
(74) *Attorney, Agent, or Firm* — Albert Bordas, P.A.

(57) ABSTRACT

A dental chair armrest having a stationary bar assembly, a movable bar assembly, and a supporting assembly. The stationary bar assembly is removably mounted onto a dental chair. The stationary bar assembly has a stationary bar, a plate, and a stationary bar nut. The stationary bar has first and second studs, and a threaded stud. The movable bar assembly has a bar and a movable bar nut. The bar has a hole and a bar stud that perpendicularly extends from the bar. The supporting assembly has an adjustable bar, a platform, a swivel, and a support pad. The adjustable bar comprises at least two holes. The platform is connected to the adjustable bar with a swivel, and the support pad is mounted onto the platform. The stationary bar assembly is connected to the movable bar assembly, and the movable bar assembly is connected to the supporting assembly.

17 Claims, 4 Drawing Sheets

(56) References Cited

U.S. PATENT DOCUMENTS

| | | | | |
|---|---|---|---|---|
| 6,142,570 | A * | 11/2000 | Bergsten | A47B 21/0371 297/411.23 |
| 6,203,109 | B1 * | 3/2001 | Bergsten | A47B 21/0371 297/411.35 |
| 6,520,587 | B2 * | 2/2003 | Noiseux | A47C 1/03 297/173 |
| 7,487,563 | B2 * | 2/2009 | Rutherford | A61B 90/60 248/118 |
| 7,493,719 | B2 * | 2/2009 | Lackey | F41A 23/04 211/64 |
| 2002/0109387 | A1 * | 8/2002 | Noiseux | A47C 1/03 297/411.37 |
| 2002/0145092 | A1 * | 10/2002 | Davies | A47G 7/041 248/231.41 |
| 2002/0158492 | A1 * | 10/2002 | Ko | A47C 7/54 297/112 |
| 2006/0108841 | A1 * | 5/2006 | Steenson | A47C 7/70 297/135 |
| 2007/0273194 | A1 * | 11/2007 | Fraser | A47C 7/383 297/397 |
| 2009/0266954 | A1 * | 10/2009 | Kordecki | A47C 7/70 248/220.21 |
| 2010/0040360 | A1 * | 2/2010 | Scott | F16M 11/10 396/428 |
| 2010/0237207 | A1 * | 9/2010 | Cabral | E06C 7/14 248/211 |
| 2015/0354766 | A1 * | 12/2015 | Townsend, Jr. | F16M 13/022 362/370 |
| 2016/0177993 | A1 * | 6/2016 | Anderson | B60M 1/24 248/70 |
| 2019/0060155 | A1 * | 2/2019 | Corrigan | A61H 3/00 |

* cited by examiner

DENTAL CHAIR ARMREST

BACKGROUND OF THE INVENTION

1. Field of the Invention

The present invention relates to medical supporting equipment, and more particularly, to dental chair armrest devices.

2. Description of the Related Art

More than 75% of dentists have been found to suffer some form of musculoskeletal pain or disorder, working many hours over extended periods, with backs bent, arms and hands suspended with no form of support. Therefore, there is a need to provide some form of support, for their arm/arms, in order to reduce muscular fatigue and/or the recurrence of lesions in the joints, limbs, and muscles and tendons of the upper and lower torso.

Applicant is not aware of any dental chair armrest having the novel features of the present invention.

SUMMARY OF THE INVENTION

The present invention is a dental chair armrest, comprising: a stationary bar assembly, a movable bar assembly, and a supporting assembly, whereby the stationary bar assembly is removably mounted onto a dental chair.

The stationary bar assembly comprises a stationary bar having first and second stationary bar ends, a plate, first and second nuts, and a stationary bar nut. The stationary bar comprises first and second studs. A threaded stud extends from the second stationary bar end. The plate comprises first and second plate holes to receive the first and second studs.

The movable bar assembly comprises a bar having first and second ends, and a movable bar nut. The bar comprises a hole positioned relatively close to the first end. A bar stud perpendicularly extends from the bar close to the second end.

The supporting assembly comprises an adjustable bar, a platform, and a support pad. The adjustable bar comprises an upper end, a lower end, and at least two holes. The supporting assembly further comprises a swivel. The swivel connects the platform and the adjustable bar. The support pad is mounted onto the platform.

The stationary bar assembly is connected to the movable bar assembly, and the movable bar assembly is connected to the supporting assembly. The stationary bar assembly is connected to the movable bar assembly, whereby the threaded stud passes through the hole and the stationary bar nut secure it. The movable bar assembly is connected to the supporting assembly, whereby the bar is secured to the adjustable bar with the movable bar nut. The platform is able to rotate 360 degrees onto the adjustable bar. The stationary bar assembly is mounted to the dental chair, whereby the stationary bar is secured to a headrest column with the plate and the first and second nuts. The adjustable bar comprises the at least two holes to adjust the height of the support pad. The movable bar assembly rotates in a clockwise or counter clockwise direction providing longitudinal adjustments.

It is therefore one of the main objects of the present invention to provide a dental chair armrest that may be easily mounted or attached, without tools, to a dentist or oral surgeon patient's chair.

It is another object of this invention to provide a dental chair armrest that allows movement of a support pad in directions parallel to a patient's body.

It is another object of this invention to provide a dental chair armrest that allows adjustments of the support pad in multiple dimensions.

It is another object of this invention to provide a dental chair armrest that may be mounted onto either or both sides of a patient's head.

It is another object of this invention to provide a dental chair armrest that is volumetrically efficient for carrying, transporting, and storage.

It is another object of this invention to provide a dental chair armrest that can be readily assembled and disassembled without the need of any special tools.

It is another object of this invention to provide a dental chair armrest, which is of a durable and reliable construction.

It is yet another object of this invention to provide a dental chair armrest that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
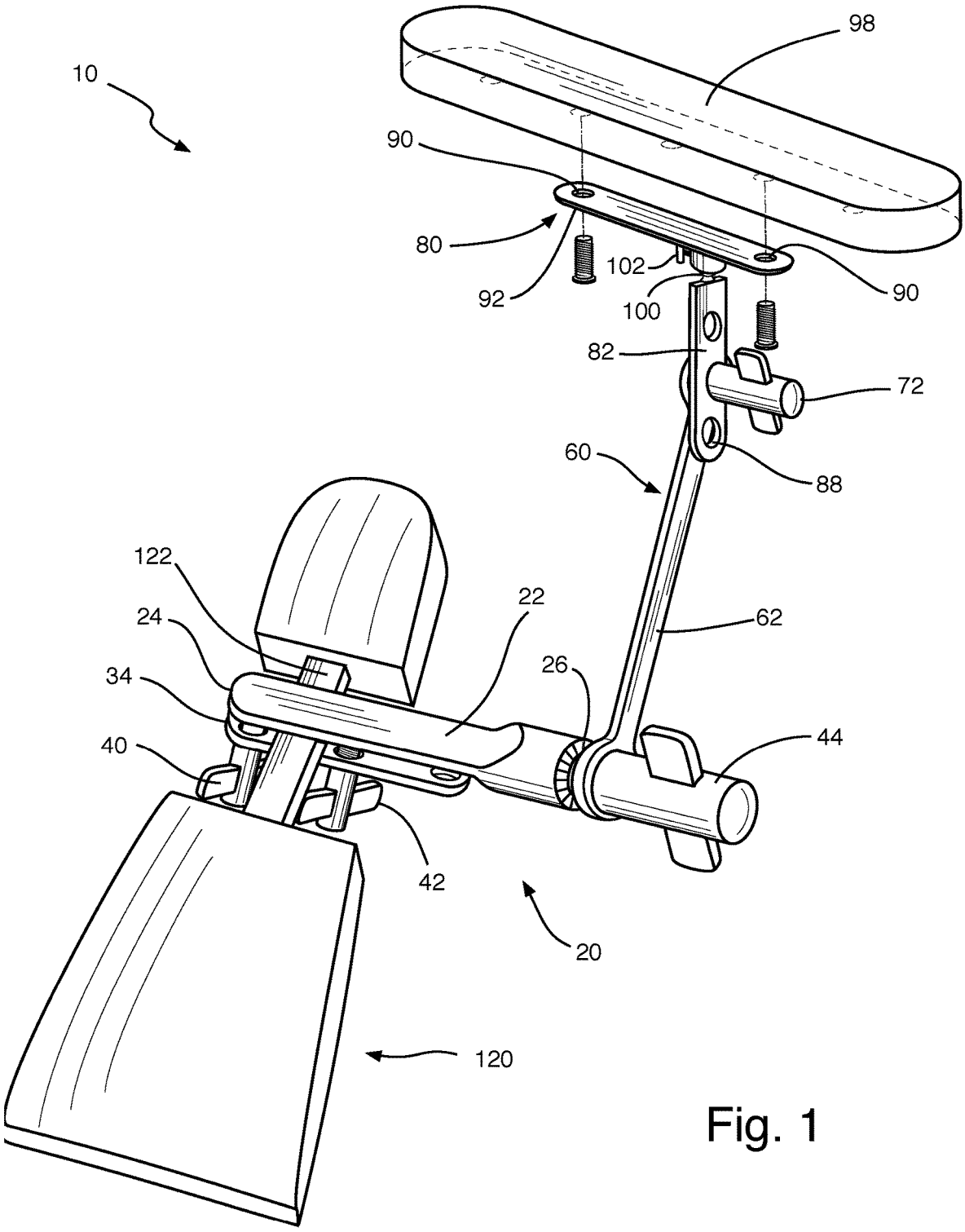
FIG. 1 is an isometric view of the present invention.

Referring now to the drawings, the present invention is a dental chair armrest, and is generally referred to with numeral 10. It can be observed that it basically includes stationary bar assembly 20, movable bar assembly 60, and supporting assembly 80.

As seen in FIG. 1, stationary bar assembly 20 connects to movable bar assembly 60, and movable bar assembly 60 connects to supporting assembly 80. Stationary bar assembly 20 is removably mounted onto dental chair 120, whereby stationary bar 22 is secured to headrest column 122 with plate 34 and first and second nuts 40 and 42 respectively. In a preferred embodiment, first and second nuts 40 and 42 with rounded corners. It is noted that the extended wings on first and second nuts 40 and 42 are used so that they may be tightened and loosened by hand force, therefore not needing tools.

Stationary bar assembly 20 is secured to movable bar assembly 60 by stationary bar nut 44. It is noted that the extended wings on stationary bar nut 44 are used so that they may be tightened and loosened by hand force, therefore not needing tools. Movable bar assembly 60 is secured to supporting assembly 80 by movable bar nut 72. It is noted that the extended wings on movable bar nut 72 are used so that they may be tightened and loosened by hand force, therefore not needing tools. Platform 92 connects to adjustable bar 82 with swivel 100, and support pad 98 is mounted onto platform 92. Platform 92 is able to rotate 360 degrees and tilt while mounted onto adjustable bar 82.

Adjustable bar 82 comprises a plurality of holes 88 to adjust the height of support pad 98. Movable bar assembly 60 rotates in a clockwise or counter clockwise direction providing longitudinal adjustments.

Figure 2:
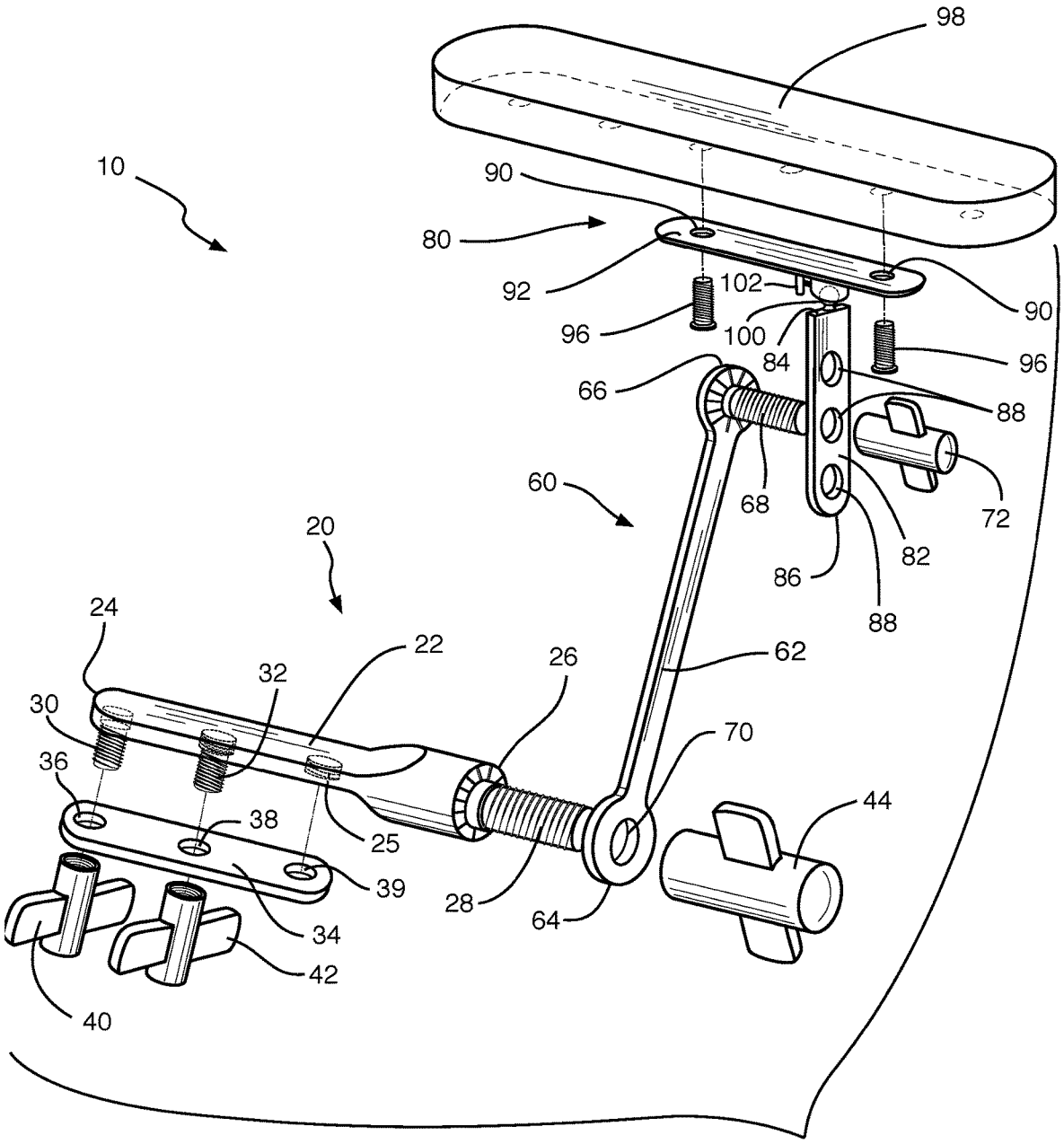
FIG. 2 is an exploded view of the present invention.

As seen in FIG. 2, stationary bar assembly 20 comprises stationary bar 22 having first and second stationary bar ends 24 and 26, plate 34, first and second nuts 40 and 42, and stationary bar nut 44. Is noted that first stationary bar end 24 is of a flat configuration, and second stationary bar end 26 is of a cylindrical configuration. Stationary bar 22 comprises first stud 30 that is positioned relatively close to first stationary bar end 24 at the flat configuration, and second stud 32 that is a predetermined distance from first stud 30 and also at the flat configuration. It is noted that second stud 32 may be removed and inserted into threaded hole 25 for a wider adjustment. From second stationary bar end 26 extends threaded stud 28.

Plate 34 comprises first and second plate holes 36 and 38 to receive first and second studs 30 and 32 respectively. Plate 34 also comprises third plate hole 39 to receive second stud 32 for a wider configuration, whereby second stud 32 is moved to threaded hole 25. In a preferred embodiment, first and second studs 30 and 32 are threaded.

Movable bar assembly 60 comprises bar 62 having first and second ends 64 and 66, and movable bar nut 72. It is noted that the extended wings on movable bar nut 72 are used so that they may be tightened and loosened by hand force, therefore not needing tools. Bar 62 comprises a single hole 70 and a single bar stud 68. It is noted that end 66 comprises a serrated face extending from a perimeter of bar stud 68. Bar stud 68 perpendicularly extends from bar 62 close to second end 66. In a preferred embodiment, bar stud 68 is threaded. The serrated face insures a positive lock between stationary bar 22 and movable bar 62 by stationary bar nut 44 without utilizing any tools.

Supporting assembly 80 comprises adjustable bar 82, platform 92, support pad 98 and swivel 100. Supporting assembly 80 is therefore rotatable. Adjustable bar 82 comprises upper end 84, lower end 86, and at least two holes 88. In a preferred embodiment, swivel 100 connects platform 92 with adjustable bar 82, whereby swivel 100 has pivoting means while mounted onto upper end 84. In a preferred embodiment, support pad 98 is made of a viscoelastic polyurethane foam covered by a moisture proof vinyl fabric.

Figure 3:
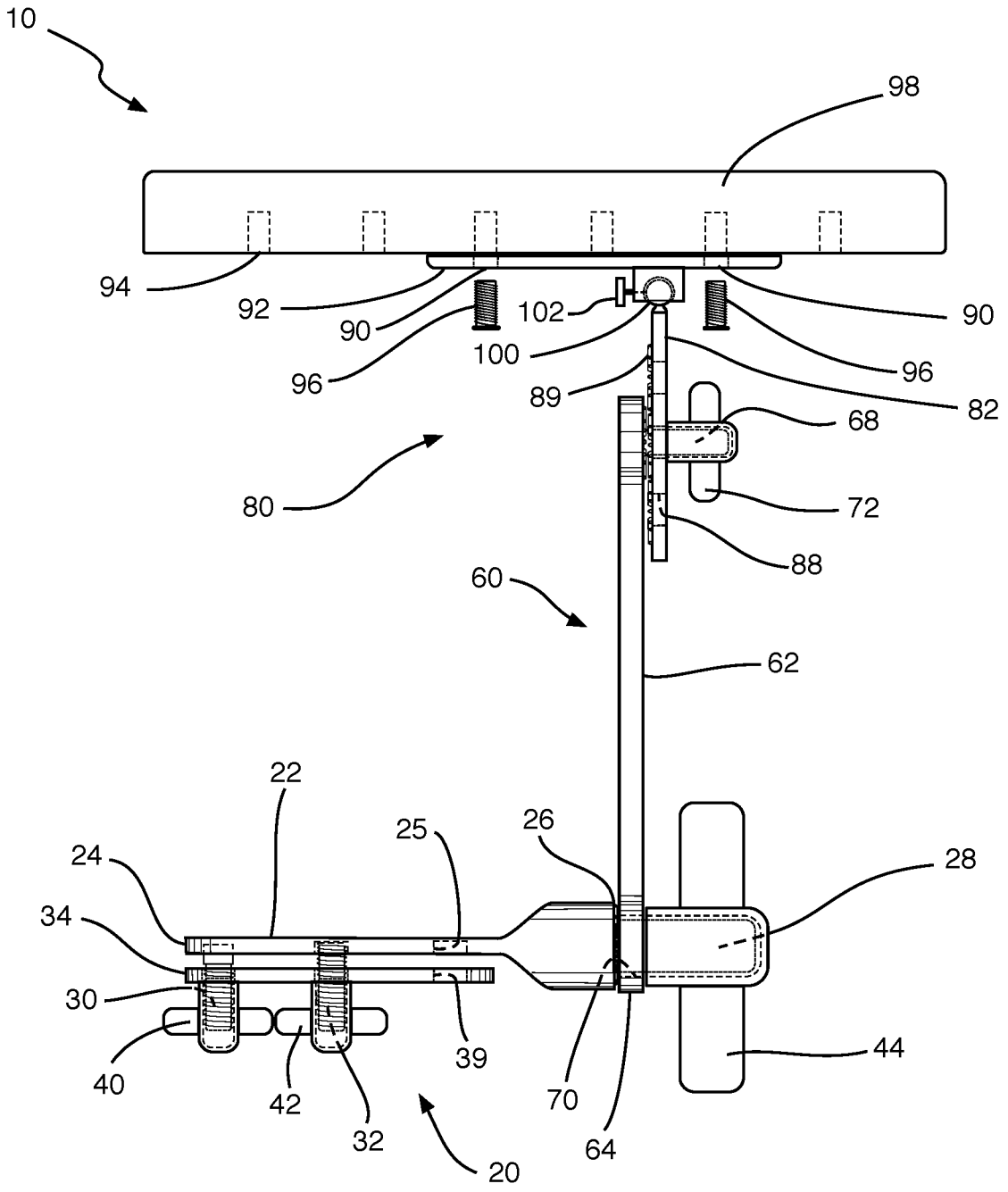
FIG. 3 is a front view of the present invention showing connections between parts.

As seen in FIG. 3, stationary bar 22 connects to bar 62, whereby threaded stud 28 passes through hole 70 and stationary bar nut 44 secures them. Movable bar assembly 60 is connected to supporting assembly 80, whereby bar stud 68 passes through one of the at least two holes 88 and movable bar nut 72 receives bar stud 68 securing bar 62 with adjustable bar 82. It is noted that serrated faces 89 on adjustable bar 82 abut the serrated face of securing bar 62 to increase friction. Noting that each of at least two holes 88 comprises serrated faces 89.

In a preferred embodiment, support pad 98 comprises multiple fixing points 94 along its longitudinal base to be fixed onto platform 92 by screws 96. In another embodiment, platform 92 comprises platform holes 90 to receive screws 96. As best seen in this illustration, set screw 102 may be tightened to lock swivel 100 in place if desired by the user. It is noted that extended wings on set screw 102 are used so that they may be tightened and loosened by hand force, therefore not needing tools. Alternatively, set screw 102 may be loosened to release swivel 100 if desired by the user.

Figure 4:
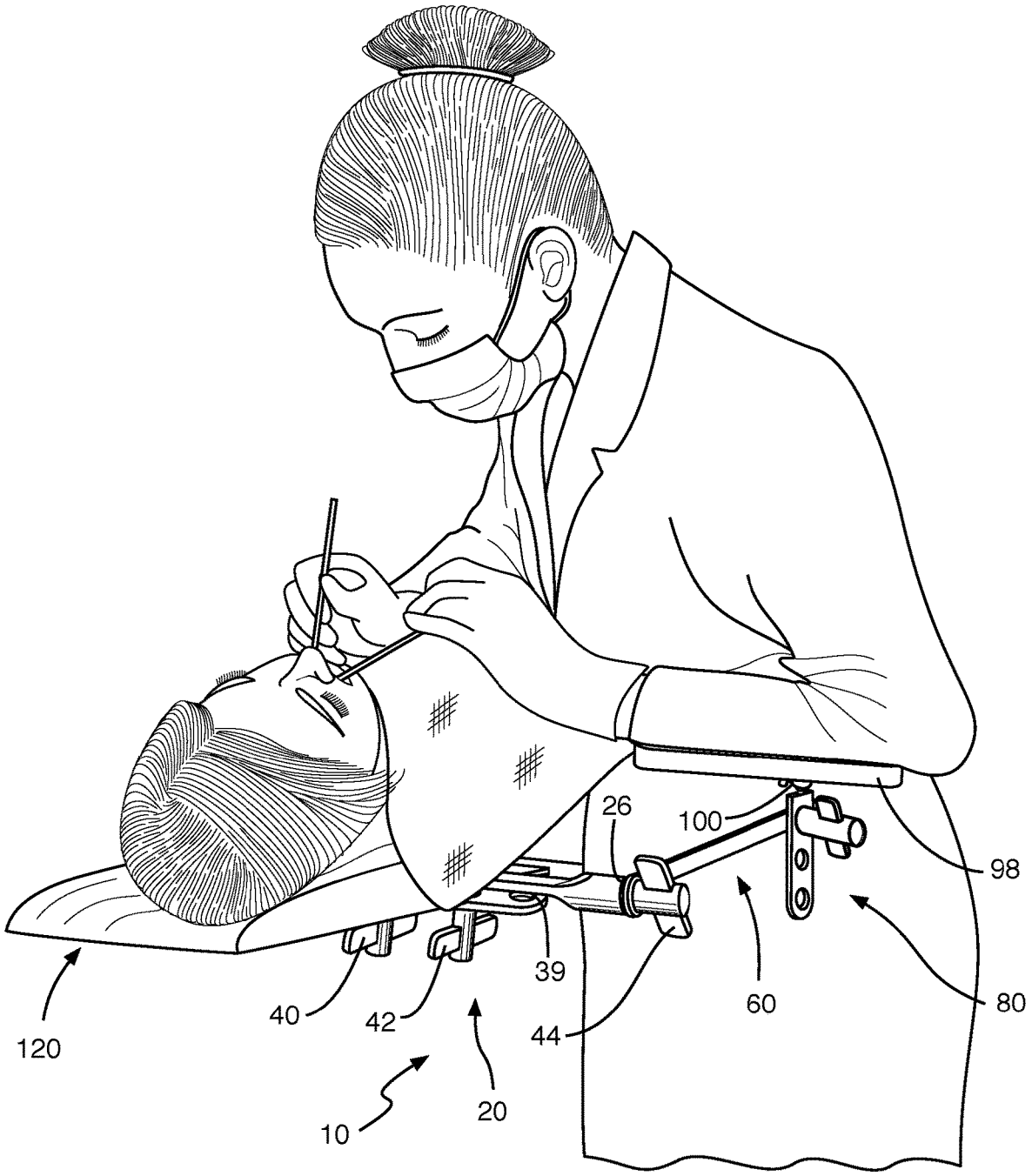
FIG. 4 is an isometric view of the present invention mounted onto a dental chair and utilized by a user, dentist, or surgeon around a patient's head.

As seen in FIG. 4, present invention 10 is a dental chair armrest for a dentist or oral surgeon while performing a procedure on a patient laying in a supine or seated position in dental chair 120. The position of supporting assembly 80 is adjustable in multiple directions. In a preferred embodiment, present invention 10 is made of brass or stainless steel with a chrome or enamel finish. Present invention 10 is easily mounted to any oral surgeon's or dental chair 120 and may be mounted onto either side of a patient's head in order to accommodate the user, dentist, or surgeon. It is also noted that by utilizing two of present invention 10, they may be mounted onto each side of a patient's head to enable the user, dentist, or surgeon to rest both arms and also minimize adjustment times. When not in use, movable bar assembly 60, and supporting assembly 80 can be pivoted down to be stored behind a back support of dental chair 120, or removed. It is noted that present invention 10 may be adjusted to accommodate the user, dentist, or surgeon to be comfortable while performing procedures on the patient. Noting that the height of dental chair 120, and the chair utilized by the user, dentist, or surgeon are taking into consideration.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A dental chair armrest, comprising:

A) a stationary bar assembly;

B) a movable bar assembly, said movable bar assembly comprises a bar having first and second ends, and a movable bar nut; and C) a supporting assembly, whereby said stationary bar assembly is removably mounted onto a dental chair, said stationary bar assembly comprises a stationary bar having first and second stationary bar ends, a plate, first and second nuts, and a stationary bar nut, a threaded stud extends from said second stationary bar end.

2. The dental chair armrest set forth in claim 1, further characterized in that said stationary bar comprises first and second studs.

3. The dental chair armrest set forth in claim 2, further characterized in that said plate comprises at least first and second plate holes to receive said first and second studs.

4. The dental chair armrest set forth in claim 1, further characterized in that said bar comprises a hole positioned relatively close to said first end.

5. The dental chair armrest set forth in claim 4, further characterized in that a bar stud perpendicularly extends from said bar close to said second end.

6. The dental chair armrest set forth in claim 5, further characterized in that said supporting assembly comprises an adjustable bar, a platform, and a support pad.

7. The dental chair armrest set forth in claim 6, further characterized in that said adjustable bar comprises an upper end, a lower end, and at least two holes.

8. The dental chair armrest set forth in claim 6, further characterized in that said supporting assembly further comprises a swivel.

9. The dental chair armrest set forth in claim 8, further characterized in that said swivel connects said platform and said adjustable bar.

10. The dental chair armrest set forth in claim 6, further characterized in that said support pad is mounted onto said platform.

11. The dental chair armrest set forth in claim 6, further characterized in that said stationary bar assembly is connected to said movable bar assembly, and said movable bar assembly is connected to said supporting assembly.

12. The dental chair armrest set forth in claim 11, further characterized in that said stationary bar assembly is connected to said movable bar assembly, whereby said threaded stud passes through said hole and said stationary bar nut secures it.

13. The dental chair armrest set forth in claim 11, further characterized in that said movable bar assembly is connected to said supporting assembly, whereby said bar is secured to said adjustable bar with said movable bar nut.

14. The dental chair armrest set forth in claim 6, further characterized in that said platform is able to tilt and/or rotate 360 degrees onto said adjustable bar.

15. The dental chair armrest set forth in claim 1, further characterized in that said stationary bar assembly is mounted to said dental chair, whereby said stationary bar is secured to a headrest column with said plate and said first and second nuts.

16. The dental chair armrest set forth in claim 7, further characterized in that said adjustable bar comprises said at least one two holes to adjust the height of said support pad.

17. The dental chair armrest set forth in claim 1, further characterized in that said movable bar assembly rotates in a clockwise or counter clockwise direction providing longitudinal adjustments.

* * * * *